US006910644B2

(12) United States Patent
Nakayama et al.

(10) Patent No.: US 6,910,644 B2
(45) Date of Patent: Jun. 28, 2005

(54) SOLENOID-OPERATED FUEL INJECTION VALVE

(75) Inventors: Masao Nakayama, Nagoya (JP); Tomoji Ishikawa, Okazaki (JP); Natsuki Sugiyama, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 169 days.

(21) Appl. No.: 10/322,496

(22) Filed: Dec. 19, 2002

(65) Prior Publication Data

US 2003/0116657 A1 Jun. 26, 2003

(30) Foreign Application Priority Data

Dec. 26, 2001 (JP) ..... 2001-394587

(51) Int. Cl.[7] ..... B05B 1/30

(52) U.S. Cl. ..... 239/585.5; 239/585.1; 239/585.3; 239/533.2; 239/533.3

(58) Field of Search ..... 239/585.5, 585.1, 239/585.2, 585.3, 585.4, 533.2, 533.3, 533.9, 88–93; 251/129.15, 129.21, 127

(56) References Cited

U.S. PATENT DOCUMENTS 3,665,901 A * 5/1972 Monpetit et al. ..... 123/490
3,942,485 A * 3/1976 Suda et al. ..... 123/490
5,320,278 A * 6/1994 Kolarik et al. ..... 239/90
5,421,521 A 6/1995 Gibson et al.
2004/0041039 A1 3/2004 Hofmann

FOREIGN PATENT DOCUMENTS

| | | |
|---|---|---|
| DE | 4403148 | 8/1995 |
| DE | 10004960 A1 | 8/2001 |
| DE | 10155271 | 5/2003 |
| JP | 61-129458 | 6/1986 |
| JP | A 8-210217 | 8/1996 |
| JP | A 9-287541 | 11/1997 |
| WO | WO 03/040546 A1 | 5/2003 |

* cited by examiner

*Primary Examiner*—Davis Hwu
(74) *Attorney, Agent, or Firm*—Oliff & Berridge, PLC

(57) ABSTRACT

A solenoid-operated fuel injection valve includes a container into which fuel is introduced, a needle member that is disposed in the container and that moves longitudinally, and an electromagnetic controller provided with first and second magnetic circuits through which suction forces can be controlled independently of each other. The electromagnetic controller changes an area of a fuel flow passage defined as a space between an inner surface of the container and an outer surface of the needle member by moving the needle member by means of the suction forces. The fuel injection valve may provide two limit strokes to achieve variable injection rates.

21 Claims, 8 Drawing Sheets

SOLENOID-OPERATED FUEL INJECTION VALVE

INCORPORATION BY REFERENCE

The disclosure of Japanese Patent Application No. 2001-394587 filed on Dec. 26, 2001, including the specification, drawings, and abstract is incorporated herein by reference in its entirety.

BACKGROUND OF THE INVENTION

1. Field of Invention

The invention relates to a solenoid-operated fuel injection valve.

2. Description of Related Art

Japanese Patent Laid-Open Application No. 8-210217 discloses a solenoid-operated fuel injection valve in accordance with the related art. In this fuel injection valve, a needle member disposed in a container into which fuel is introduced is longitudinally moved by suction forces generated by electromagnetic means, whereby the area of a fuel flow passage defined as a space between an inner surface of the container and an outer surface of the needle member is changed. After having flown through the fuel flow passage, fuel is injected from a nozzle hole.

However, the solenoid-operated fuel injection valve in accordance with the related art has the following problems. That is, the suction forces are inappropriate, and the operation of opening and closing the valve cannot be reliably performed.

SUMMARY OF THE INVENTION

The invention has been made in view of the problems mentioned above. It is an object of the invention to provide a solenoid-operated fuel injection valve that can be reliably opened and closed.

In order to solve the problems mentioned above, the invention provides a solenoid-operated fuel injection valve in which an area of a fuel flow passage defined as a space between an inner surface of a container into which fuel is introduced and an outer surface of a needle member disposed in the container is changed by moving the needle member longitudinally by means of suction forces generated by an electromagnetic controller. The electromagnetic controller is provided with first and second magnetic circuits through which the suction forces can be controlled independently of each other.

Because this solenoid-operated fuel injection valve employs first and second magnetic circuits through which the suction forces can be controlled independently of each other, the suction forces can be suitably set, and the operation of opening and closing the valve can be reliably performed. In particular, if the first and second magnetic circuits are designed to simultaneously generate suction forces during a predetermined period, the suction forces can be amplified, and the operation of opening and closing the valve can be more reliably performed.

If the first and second magnetic circuits are disposed in a longitudinal direction of the needle member, the suction forces can be increased without enlarging the dimension in a direction perpendicular to the longitudinal direction (i.e., radially).

BRIEF DESCRIPTION OF THE DRAWINGS

The above mentioned and other objects, features, advantages, technical and industrial significance of this invention will be better understood by reading the following detailed description of the exemplary embodiments of the invention, when considered in connection with the accompanying drawings, in which.

DETAILED DESCRIPTION OF PREFERRED EMBODIMENTS

Figure 1:
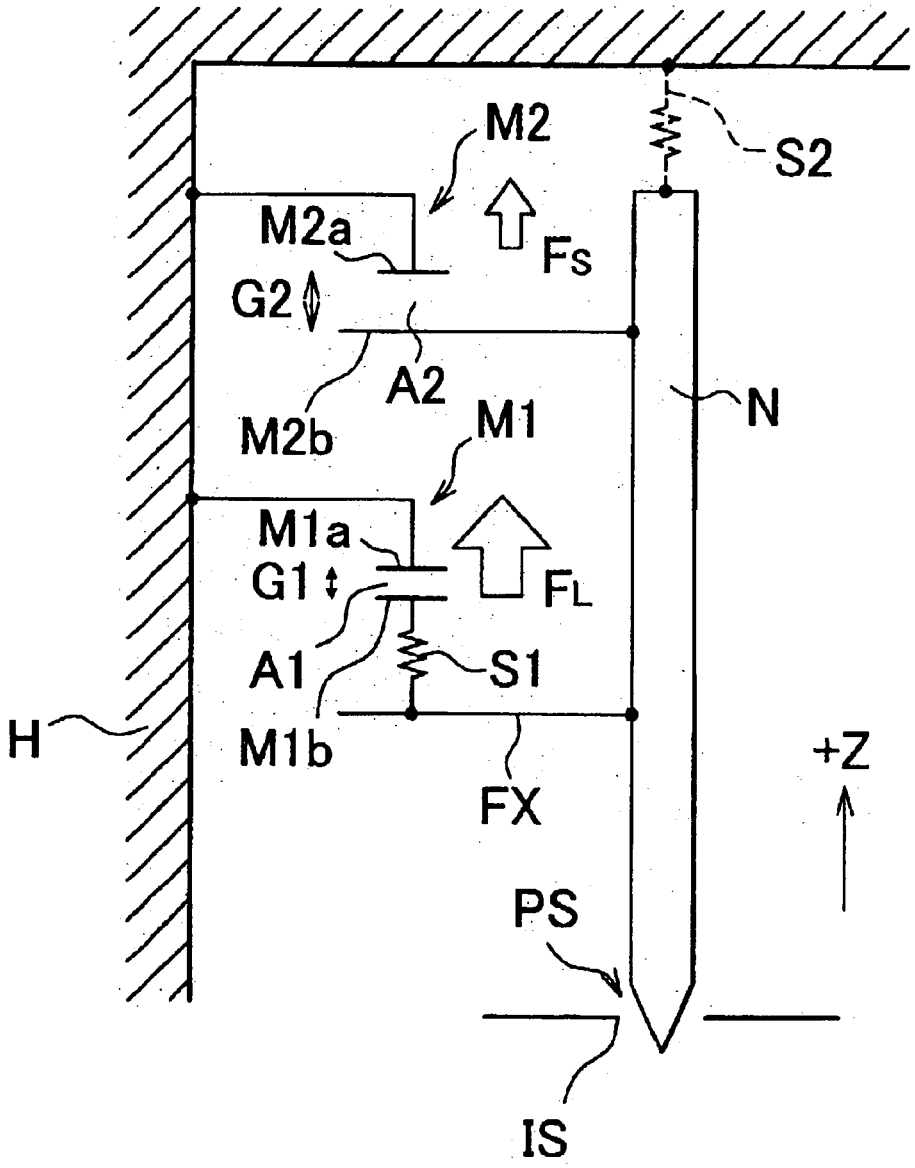
FIG. 1 is an explanatory view of a relationship of mechanical connection among internal elements of a solenoid-operated fuel injection valve in accordance with a first embodiment of the invention.

In the following description and the accompanying drawings, the invention will be described in more detail in terms of exemplary embodiments.

Solenoid-operated fuel injection valves in accordance with the embodiments will be described hereinafter. It is to be noted herein that like elements are denoted by like reference numerals and that repetition of the same description will be avoided.

A first embodiment of the invention will be described with reference to FIG. 1, which is an explanatory view of a relationship of mechanical connection among internal elements of an exemplary solenoid-operated fuel injection valve. In this solenoid-operated fuel injection valve, a needle member N disposed in a container H into which fuel is introduced is moved in the longitudinal direction (+Z direction) of the needle member N by suction forces FL, FS generated by an electromagnetic means, whereby the area of a fuel flow passage PS defined as a space between an inner surface IS of the container H and an outer surface of the needle member N changes. The electromagnetic means are provided with first and second magnetic circuits M1, M2 through which the suction forces FL, FS can be controlled independently of each other.

This solenoid-operated fuel injection valve assumes a "closed" state when the fuel flow passage PS is closed by the needle member N, and assumes an "open" state when the fuel flow passage PS has been formed. Fuel that has been introduced into the container H is injected from a fuel injection nozzle hole depending on the area of the fuel flow passage PS. Although this nozzle hole can be constructed of the fuel flow passage PS itself, it is also appropriate that the nozzle hole be formed on the rear stage side of the fuel flow passage PS.

This solenoid-operated fuel injection valve employs the first and second magnetic circuits M1, M2 through which the suction forces FL, FS can be controlled independently of each other. Therefore, the suction forces (functions of FL and FS) can be suitably set, and the solenoid-operated fuel injection valve can be reliably opened and closed. In particular, if the first and second magnetic circuits M1, M2 are designed to simultaneously generate suction forces for a predetermined period (T1, T2: see FIG. 8), the suction forces can be increased. As a result, the solenoid-operated fuel injection valve can be more reliably opened and closed.

The first magnetic circuit M1 has a pair of magnetic bodies (M1*a*, M1*b*) that are opposed and attracted to each other across a gap A1. The second magnetic circuit M2 has a pair of magnetic bodies (M2*a*, M2*b*) that are opposed and attracted to each other across a gap A2. One of the magnetic bodies M1*a*, M1*b* (M1*a* selected herein) constitutes an electromagnet. One of the magnetic bodies M2*a*, M2*b* (M2*a* selected herein) also constitutes an electromagnet. Either of the magnetic bodies constituting each pair of the magnetic bodies M1*a*, M1*b* or M2*a*, M2*b* may constitute an electromagnet.

It is to be noted herein that an electromagnet is constructed by adding a coil to a magnetic body. For convenience of explanation, however, each of the electromagnets and a corresponding one of the magnetic bodies M1*a*, M2*a* are denoted by the same reference numeral.

A magnetic body is a metal such as iron, cobalt, nickel, or the like, which is a substance generated by a magnetic pole in a magnetic field. An electromagnet can be constructed by winding a coil around such a substance. If a current is supplied to the coil, a magnetic flux generated by the current flowing through the coil and a magnetic flux generated by the magnetic pole of the magnetic body around which the coil is wound flow through the gaps A1, A2, whereby strong magnetic fields are formed in the gaps A1, A2. As a result, the suction forces FL, FS are generated in the magnetic circuits M1, M2 respectively, which include the gaps A1, A2 respectively.

It is assumed in the first embodiment that the suction force FL of the first magnetic circuit M1 is larger than the suction force FS of the second magnetic circuit M2 (FL>FS) when the solenoid-operated fuel injection valve is closed. The suction force FL of the first magnetic circuit M1 is inversely proportional to a dimension (air gap) G1 of the gap A1, and the suction force FS of the second magnetic circuit M2 is inversely proportional to a dimension (air gap) G2 of the gap A2. That is, when the solenoid-operated fuel injection valve is closed, the dimension G1 of the gap A1 is smaller than the dimension G2 of the gap A2 (G1<G2), and thus, the suction force FL is larger than the suction force FS.

The magnetic bodies M1*a*, M1*b* (M2*a*, M2*b*) are disposed between the container H and the needle member N such that the needle member N is moved in the longitudinal direction thereof (+Z direction) by the suction forces FL, FS of the magnetic bodies M1*a*, M1*b* (M2*a*, M2*b*). The first and second magnetic circuits M1, M2 are compactly disposed.

The electromagnets M1*a*, M2*a* are fixed to the container H. The magnetic body M1*b* is connected to a driving force transmission member FX via a first elastic means (spring) S1. The magnetic body M2*b* is fixed to the needle member N.

If the suction resulting from the first magnetic circuit M1 becomes effective when the solenoid-operated fuel injection valve assumes a closed state, the magnetic body M1*b* moves in the +Z direction. Then, the driving force transmission member connected to the magnetic body M1*b* moves in the +Z direction due to a spring force of the first elastic means S1. Because the driving force transmission member FX is fixed to the needle member N, the needle member N moves in the +Z direction. As a result, the fuel flow passage PS is formed, and the solenoid-operated fuel injection valve is opened. The container H and the needle member N are connected by a second elastic means (spring) S2, and the suction force FL generated by the first magnetic circuit M1 acts against a spring force of the second elastic means S2. The second elastic means S2 is provided if necessary.

When the magnetic body M1*b* is moved by the suction force $F_L$ toward the electromagnet M1*a* fixed to the container H, the magnetic body M1*b* abuts on the electromagnet M1*a*. This substantially stops the needle member N from moving. If it is assumed that the needle member N is at a reference position in the Z direction when the solenoid-operated fuel injection valve is closed, the distance between the reference position and the stop position is a limit stroke (first stroke) of the needle member N which is determined by the first magnetic circuit M1. In the first embodiment, the first stroke corresponds to the dimension G1 of the gap.

If the suction resulting from the second magnetic circuit M2 becomes effective when the solenoid-operated fuel injection valve is in a closed state, the magnetic body M2*b* moves in the +Z direction against a spring force generated by the second elastic means S2. Because the magnetic body M2*b* is fixed to the needle member N, the needle member N moves in the +Z direction. If this suction force acts when the solenoid-operated fuel injection valve is closed, the fuel flow passage PS is formed. Then, the solenoid-operated fuel injection valve is opened.

Even after the needle member N has moved in the +Z direction by the first stroke, if the needle member N is further sucked in the +Z direction by the second magnetic circuit M2, the magnetic body M2*b* further moves in the +Z direction. Then, the magnetic body M2*b* moves in the +Z direction against a spring force of the first elastic means S1 as well as a spring force of the second elastic means S2. Thus, the needle member N fixed to the magnetic body M2*b* moves in the +Z direction. If the magnetic body M2*b* abuts on the electromagnet M2*a*, the second magnetic circuit M2 stops the needle member N from moving. If it is assumed that the needle member N is at a reference position in the Z direction when the solenoid-operated fuel injection valve is closed, the distance between the reference position and a stop position is a second limit stroke (second stroke) of the needle member N which is determined by the second magnetic circuit M2. In the first embodiment, the second stroke corresponds to the dimension G2 of the gap. It is to be noted herein that there are some cases where the stroke is not equal to the dimension of the gap.

The first stroke (=G1) of the needle member N which is determined by the first magnetic circuit M1 is shorter than the second stroke (=G2) of the needle member N which is determined by the second magnetic circuit M2. Thus, since the strokes are different from each other, the solenoid-operated fuel injection valve of the first embodiment makes it possible to change the area of the fuel flow passage PS in accordance with the strokes and to perform fuel injection control with high precision.

The dimension G1 of the gap A1 of the first magnetic circuit M1 at the time when no suction force has been generated (i.e., when the solenoid-operated fuel injection valve is closed) is smaller than the dimension G2 of the gap A2 of the second magnetic circuit M2 at the time when no suction force has been generated (i.e., when the solenoid-operated fuel injection valve is closed). As described above, the suction force is increased in proportion to a decrease in the gaps. The moment the area of the fuel flow passage PS is increased from zero, the difference between pressures inside and outside the fuel injection nozzle hole strengthens a valve-closing force. Hence, at this moment, the solenoid-operated fuel injection valve requires a suction force larger than the suction force that is applied after the operation of opening the solenoid-operated fuel injection valve has been started.

Thus, the moment the area of the fuel flow passage PS is increased from zero, a suction force is generated at least in the first magnetic circuit M1 in which the needle member has the shorter stroke. If the suction force FL on the side of the first magnetic circuit M1 during closure of the solenoid-operated fuel injection valve is increased by reducing the dimension G1 of the gap A1, the area of the fuel flow passage PS can be smoothly increased. Once the fuel flow passage PS has been formed, the needle member N can be moved by a relatively small force. Thus, the second stroke can be set as a stroke longer than the first stroke, and fuel injection control can be performed with high precision.

Further, the solenoid-operated fuel injection valve is provided with the first and second elastic means S1, S2, which urge the needle member N against a suction force if the needle member N has moved by the first stroke or more in a direction of application of the suction force. The first elastic means S1 is disposed in such a manner as to apply a force to the needle member N in the same direction as a suction force if the needle member N moves by a stroke shorter than the first stroke in a direction of application of the suction force. When the needle member N makes a return stroke between the first and second strokes (i.e., when the needle member N is moved by urging forces of the elastic means S1, S2 reversely with respect to the direction of application of the suction force), the needle member N can be moved by a resultant force of the first and second elastic means S1, S2. Further, if a suction force is applied to the needle member N while a stroke shorter than the first stroke is made, the first elastic means S1 does not act against the suction force. Thus, the needle member N can be moved at a high speed.

One of the magnetic bodies (M1*a*) of the first magnetic circuit M1 is fixed to the container H, whereas the other (M1*b*) is movable with respect to the needle member N and is designed to allow a suction force to be indirectly transmitted to the needle member N. Because the other magnetic body (M1*b*) indirectly transmits the suction force FL, undesirable resonance of the needle member during a return stroke can be suppressed.

The aforementioned solenoid-operated fuel injection valve can be subject to various modifications.

Figure 2:
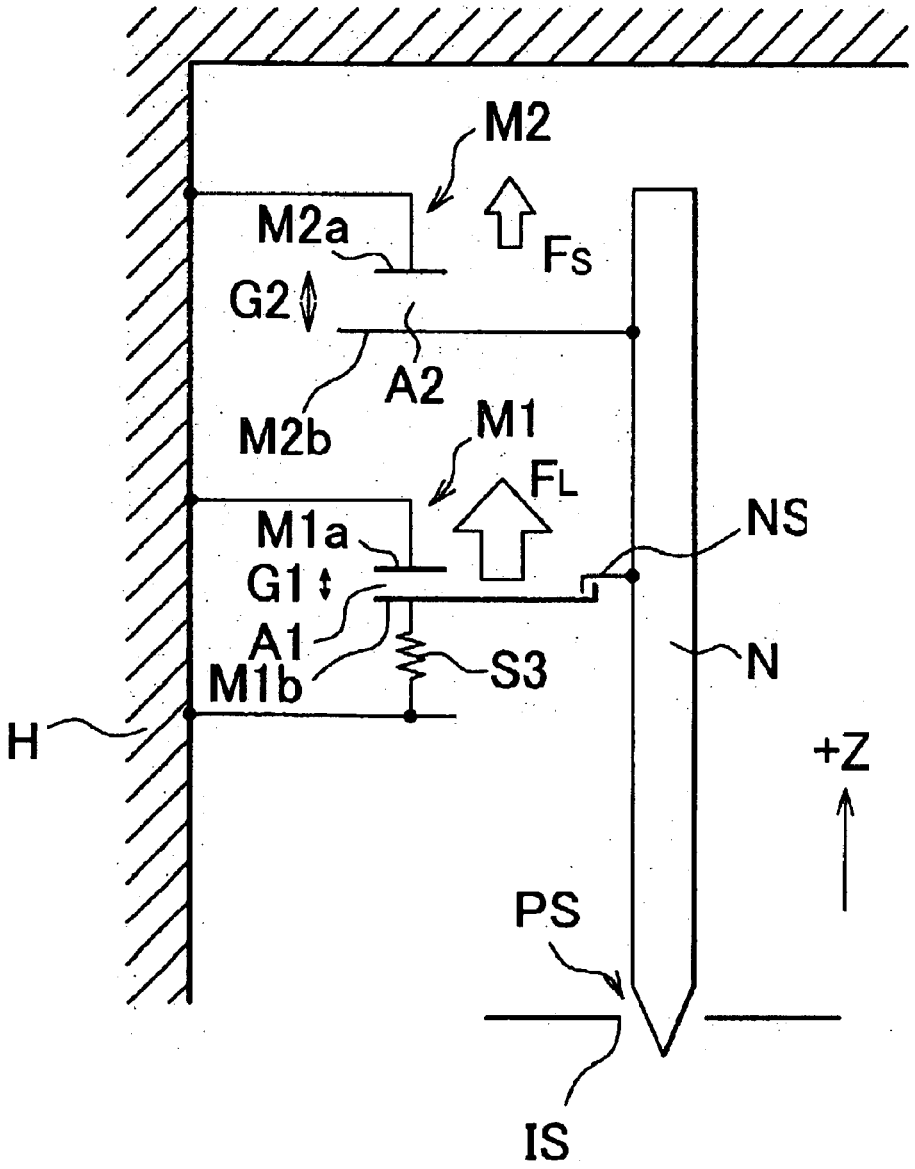
FIG. 2 is an explanatory view of a relationship of mechanical connection among internal elements of a solenoid-operated fuel injection valve in accordance with a second embodiment of the invention.

FIG. 2 is an explanatory view of a relationship of mechanical connection among internal elements of the solenoid-operated fuel injection valve in accordance with a second embodiment. As in the case of the aforementioned fuel injection valve, the needle member N disposed in the container H into which fuel is introduced is moved in the longitudinal direction (+Z direction) of the needle member N by the suction forces FL, FS generated by the electromagnetic means, whereby the area of the fuel flow passage PS defined as a space between the inner surface IS of the container H and the outer surface of the needle member N changes. This electromagnetic means is provided with the first and second magnetic circuits M1, M2 through which the suction forces FL, FS can be controlled independently of each other. The solenoid-operated fuel injection valve of the second embodiment is different from the one shown in FIG. 1 in that the first elastic means S1 is not provided. Additionally, the magnetic body M1*b* can abut on a stopper member NS fixed to the needle member N at the time of suction. Further, the magnetic body M1*b* is connected to the container H via a third elastic means (spring) S3. The solenoid-operated fuel injection valves of the first and second embodiments are identical in other constructional details.

If a suction force of the first magnetic circuit M1 acts on the magnetic body M1*b*, the stopper member NS that abuts on the magnetic body M1*b* moves in the +Z direction, and the needle member moves in the +Z direction. In the case where an additional stroke is required, if a suction force generated by the second magnetic circuit M2 is applied, the needle member N moves by more than the first stroke, whereby the magnetic body M1*b* and the stopper member NS are separated from each other. The solenoid-operated fuel injection valves of the first and second embodiments are identical in other operational details.

Figure 3:
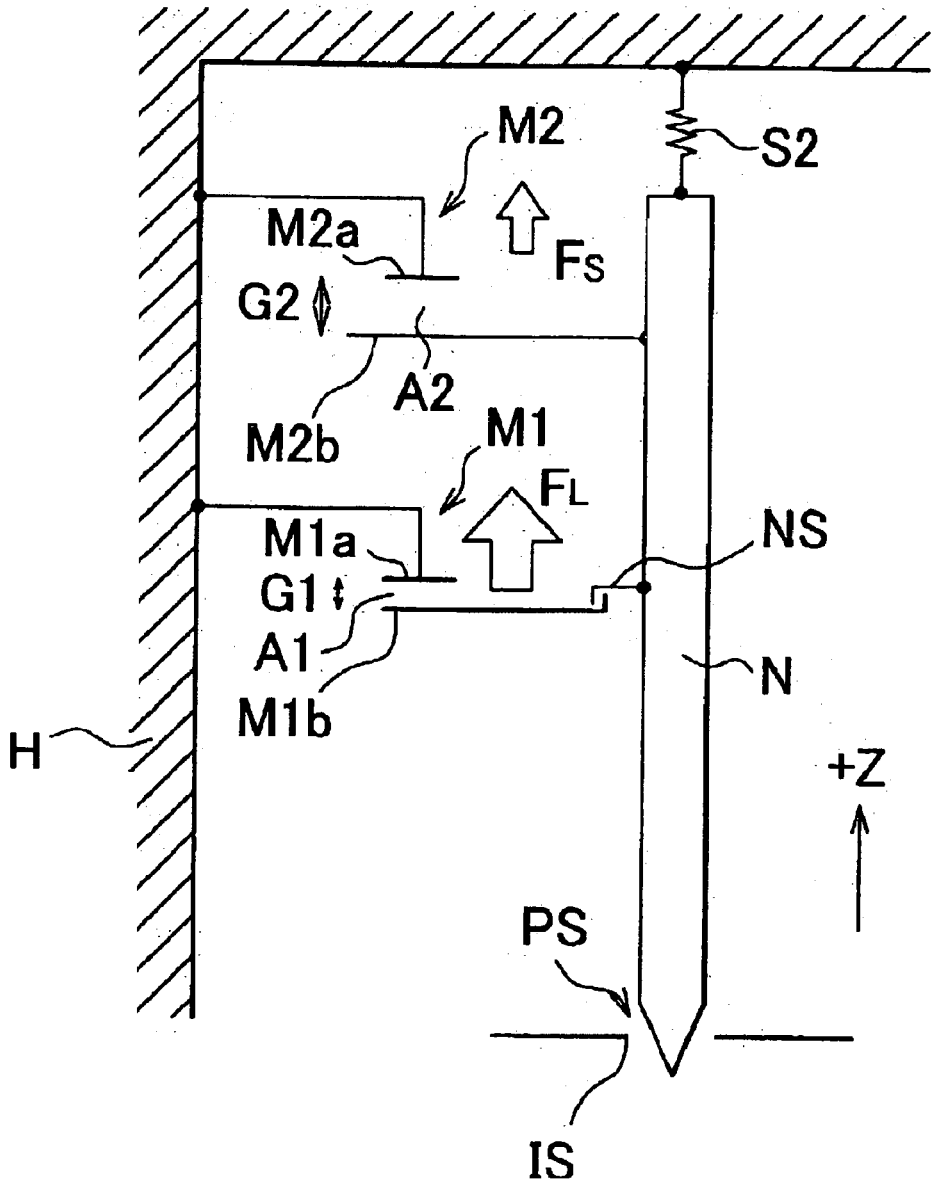
FIG. 3 is an explanatory view of a relationship of mechanical connection among internal elements of a solenoid-operated fuel injection valve in accordance with a third embodiment of the invention.

FIG. 3 is an explanatory view of a relationship of mechanical connection among internal elements of the solenoid-operated fuel injection valve in accordance with a third embodiment. As in the case of the aforementioned fuel injection valves, the needle member N disposed in the container H into which fuel is introduced is moved in the longitudinal direction (+Z direction) of the needle member N by the suction forces FL, FS generated by the electromagnetic means, whereby the area of the fuel flow passage PS defined as a space between the inner surface IS of the container H and the outer surface of the needle member N changes. This electromagnetic means is provided with the first and second magnetic circuits M1, M2 through which the suction forces FL, FS can be controlled independently of each other.

The solenoid-operated fuel injection valve of the third embodiment is different from the one shown in FIG. 1 in that the first elastic means S1 is not provided. Additionally the magnetic body M1*b* can abut on the stopper member NS fixed to the needle member N at the time of suction. Further, the magnetic body M1*b* is sucked against the second elastic means S2. The magnetic body M1*b* is designed to be slidable with respect to a suitable member. The solenoid-operated fuel injection valves of the first and third embodiments are identical in other constructional details. As is apparent from the foregoing description, the construction of the elastic means and the mode of mechanical connection are abundant in variations.

Figure 4:
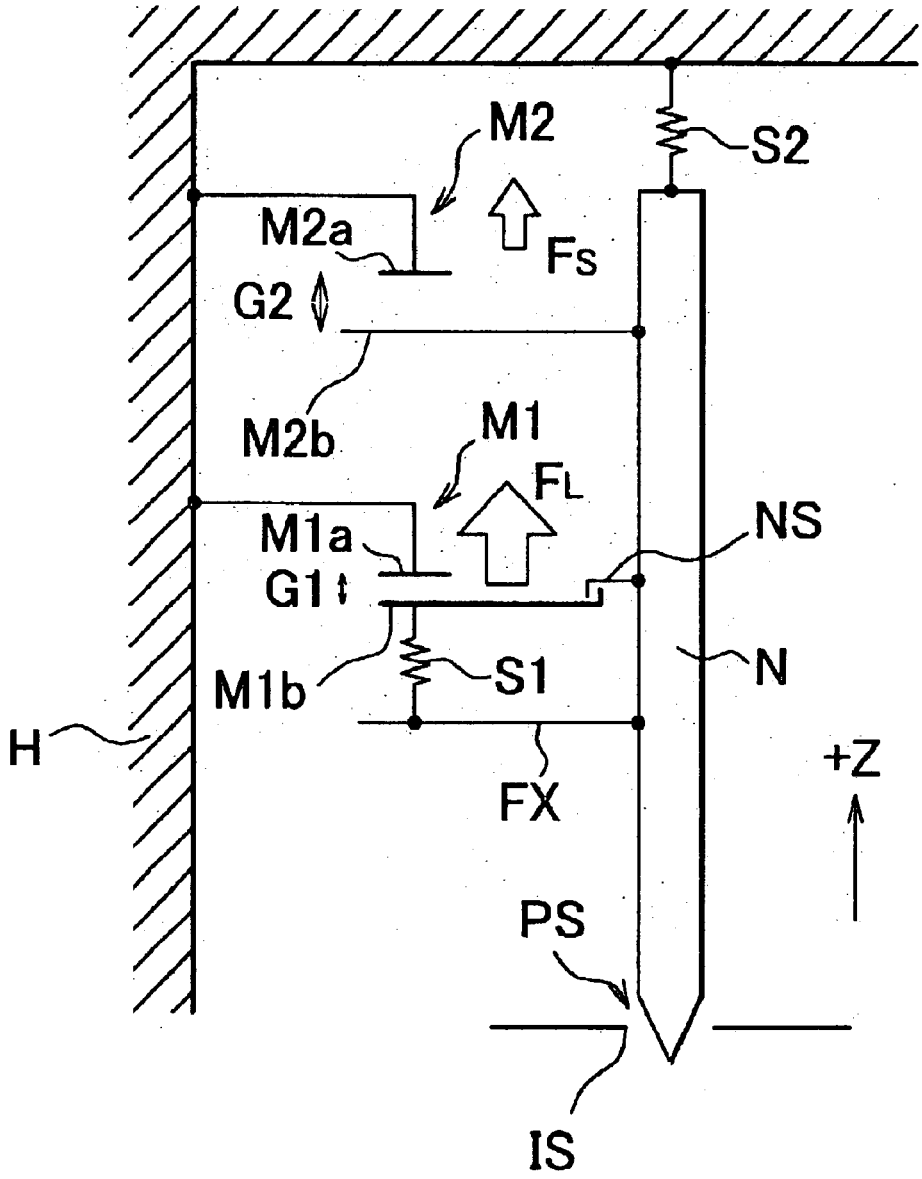
FIG. 4 is an explanatory view of a relationship of mechanical connection among internal elements of a solenoid-operated fuel injection valve in accordance with a fourth embodiment of the invention.

FIG. 4 is an explanatory view of a relationship of mechanical connection among internal elements of the solenoid-operated fuel injection valve in accordance with a fourth embodiment. The solenoid-operated fuel injection valve of the fourth embodiment is basically constructed in the same manner as the solenoid-operated fuel injection valve of a first embodiment shown in FIG. 1, but is additionally designed such that the magnetic body M1*b* can abut on the stopper member NS fixed to the needle member N at the time of suction. If the magnetic body M1*b* has not moved by the first stroke, the needle N is sucked against the second elastic means. If the magnetic body M1*b* has moved by the first stroke or more, needle N is sucked against the first and second elastic means S1, S2.

If the needle member N moves too fast when making a return stroke, it bounds upon abutment on the inner surface IS of the container H. As a result, so-called secondary injection occurs. Secondary injection is undesirable in terms of open-close controllability and fuel consumption.

The solenoid-operated fuel injection valve of the fourth embodiment is provided with the elastic means S2 (S1) and the stopper member NS. If the needle member N has moved in the direction of application of a suction force (i.e., in the +Z direction), the elastic means S2 (S1) urges the needle member N against the suction force. The needle member N is provided with the stopper member NS such that the needle member N hits a certain member (the magnetic body M1*b* in this embodiment) at a predetermined position between the reference position of the needle member N during closure of the solenoid-operated fuel injection valve and a position corresponding to the first stroke if the needle member N is moved by an urging force of the elastic means S2 (S1) reversely with respect to the direction of application of the suction force (i.e., in the −Z direction).

In this construction, when the needle member N makes a return stroke, the stopper member NS hits the magnetic body M1*b* fixed to the elastic means S1, which performs an impact-absorbing function. Thus, if the needle member N hits the magnetic body M1*b* during a return stroke, the speed of the needle member N decreases before the needle member N abuts on the inner surface IS of the container. As a result, the amount of secondary injection is reduced. It is also appropriate that the stopper member NS be elastically supported.

Next, concrete constructional examples of the aforementioned solenoid-operated fuel injection valves of FIG. 4 will be described.

Figure 5:
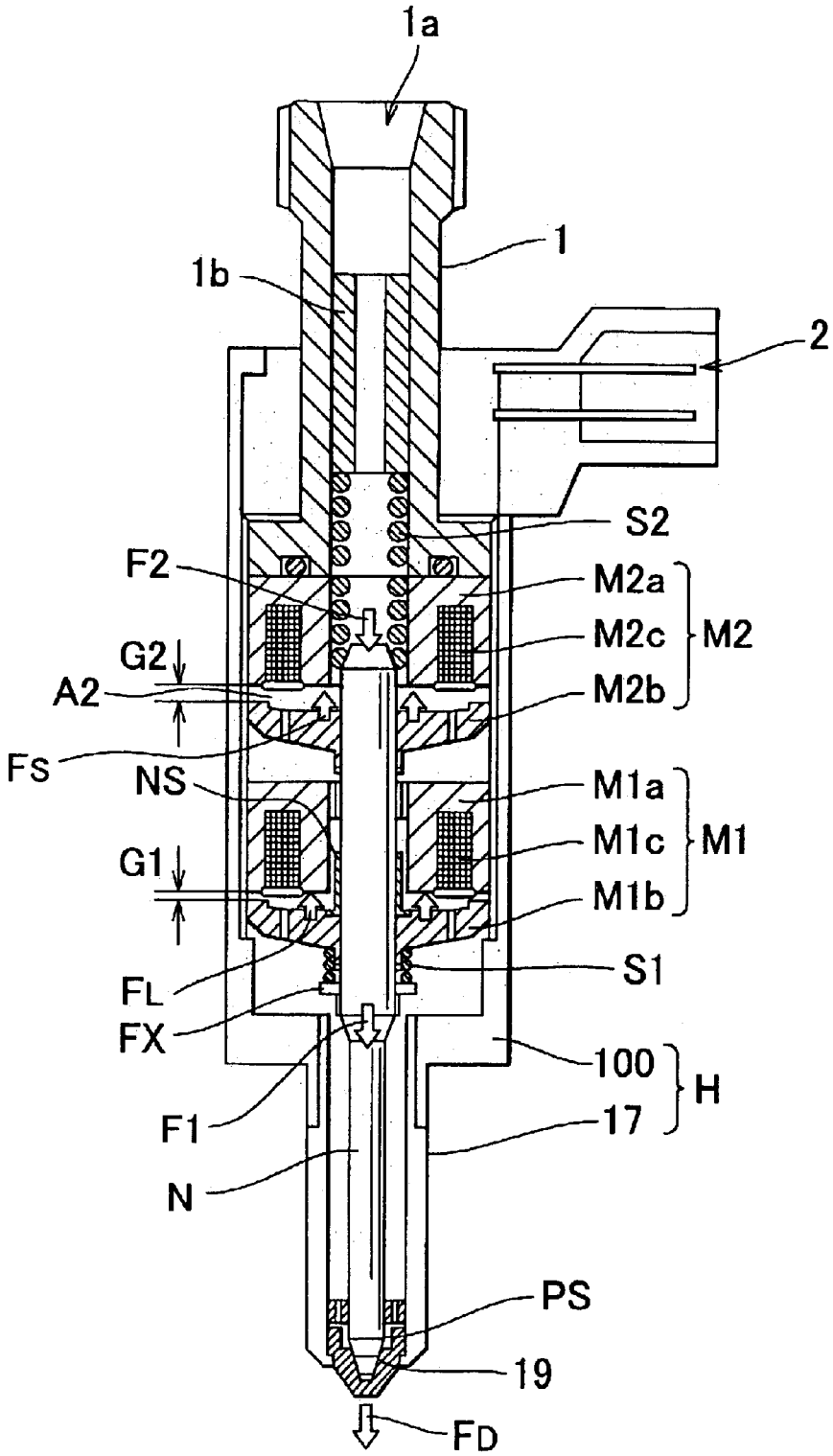
FIG. 5 is a longitudinal sectional view of the solenoid-operated fuel injection valve in accordance with the fourth embodiment.

FIG. 5 is a detailed longitudinal sectional view of the solenoid-operated fuel injection valve in accordance with the fourth embodiment.

In this solenoid-operated fuel injection valve, fuel is supplied to the container H from a fuel supply port la located at an end of a fuel supply pipe 1. The container H is composed of a container body 100 and a nozzle 17 that is fitted to a longitudinal leading end of the container body 100. The needle member (needle valve) N is disposed in the container body 100, and extends to the interior of the nozzle 17. The first and second magnetic circuits M1, M2 are disposed between the container body 100 and the needle valve N.

The first magnetic circuit M1 has a first electromagnet (M1*a*, M1*c*), which is composed of the cylindrical magnetic body (first core) M1*a* and a first coil M1*c* embedded in the first core M1*a*. The first magnetic circuit M1 is also provided with the annular magnetic body (first armature) M1*b*. The needle valve N, which can slide relative to the first armature M1*b*, is located in an opening of the first armature M1*b*. The first armature M1*b* is connected to the driving force transmission member FX via the first elastic means (first spring) S1, and is elastically coupled to the needle valve N.

The second magnetic circuit M2 has a second electromagnet (M2*a*, M2*c*), which is composed of the cylindrical magnetic body (second core) M2*a* and a second core M2*c* embedded in the magnetic body M2*a*. The second magnetic circuit M2 is also provided with the annular magnetic body (second armature) M2*b*. The needle valve N is securely fitted in an opening of the second armature M2*b*. The second armature M2*b* is connected to the container H via the second elastic means (second spring) S2, and is elastically coupled to the container H. In this constructional example, a sleeve 1*b* in the fuel supply pipe 1 fixed to the container H functions as a stopper, and the second spring S2 is interposed between the sleeve 1*b* and a base end portion of the needle valve N.

A connector 2 for supplying currents to the coils M1*c*, M2*c* is fitted to the container H. By supplying currents to the coils M1*c*, M2*c* respectively, the suction forces FL, FS are generated independently of each other.

Fuel that has been introduced from the fuel supply port 1*a* flows through an internal region of the second core M2*a*, a fuel passage formed in the armature M2*b* or the like, an internal region of the first core M1*a*, and a fuel passage formed in the first magnetic body M1*b* or the like, reaches the interior of the nozzle 17, and further moves to the extent of almost reaching the fuel flow passage (fuel seal portion) PS. A nozzle hole 19 is formed at a leading end of the nozzle 17. When the solenoid-operated fuel injection valve is open, fuel is injected from the nozzle hole 19. Although the operation of the solenoid-operated fuel injection valve has been described above, it will be described hereinafter in more detail.

Figure 6A:
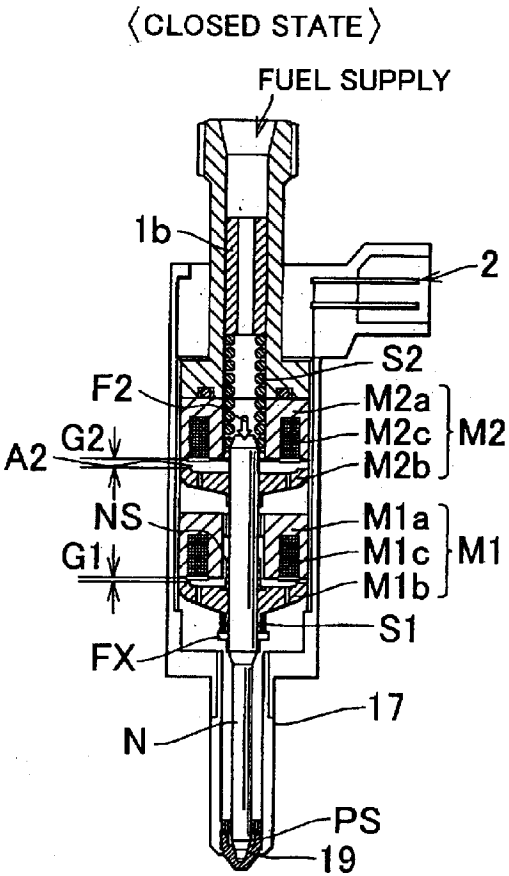
FIG. 6*a* is a longitudinal sectional view of the solenoid-operated fuel injection valve in accordance with the fourth embodiment in a closed state.
Figure 6B:
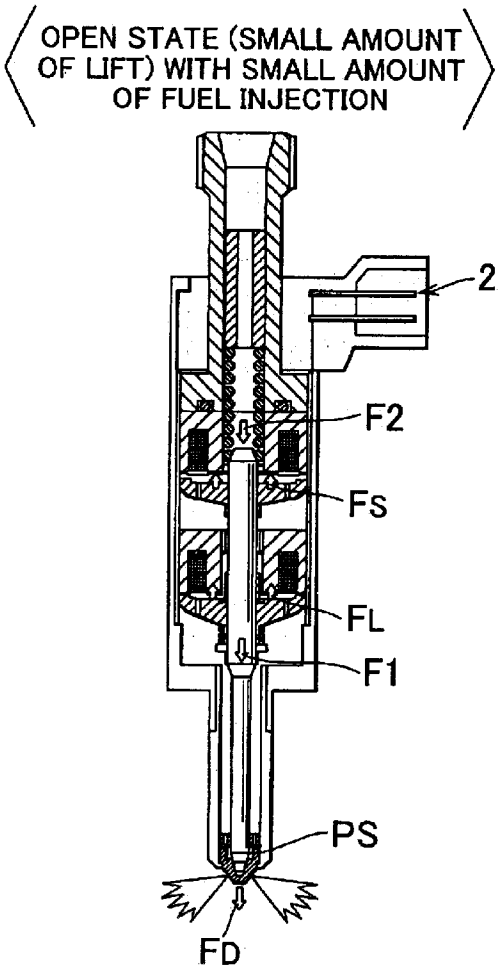
FIG. 6*b* is a longitudinal sectional view of the solenoid-operated fuel injection valve in accordance with the fourth embodiment in an open state with a small fuel injection amount.
Figure 6C:
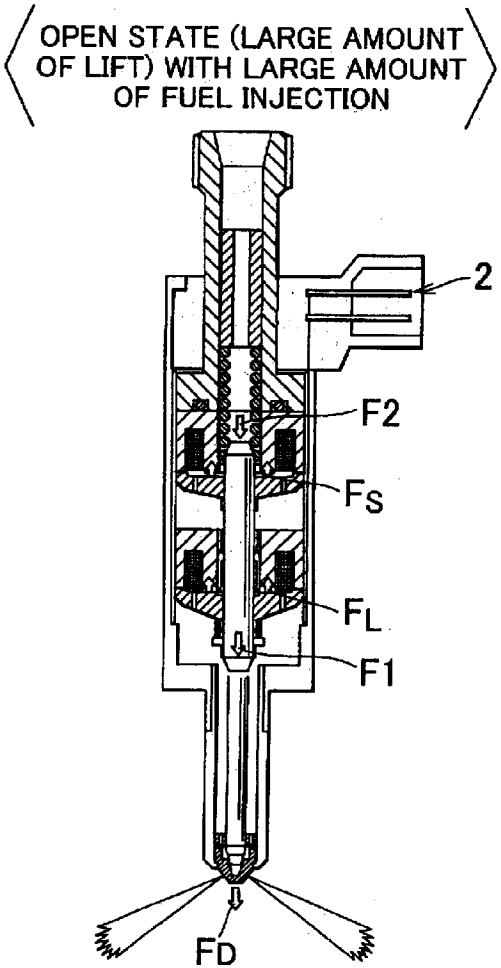
FIG. 6*c* is a longitudinal sectional view of the solenoid-operated fuel injection valve in accordance with the fourth embodiment in an open state with a large fuel injection amount.

FIG. 6 shows longitudinal sectional views of the solenoid-operated fuel injection valve in respective states.

When the solenoid-operated fuel injection valve is closed as shown in FIG. 6*a*, no current is supplied from the connector 2. In this state, the needle valve N is urged toward the fuel seal portion PS by a second spring force (urging force) F2 generated by the second spring, and the outer surface of the needle valve N closes the fuel seal portion PS.

To shift the solenoid-operated fuel injection valve to an open state with a small fuel injection amount shown in FIG. 6*b*, currents are supplied from the connector 2 to the first and second coils M1*c*, M2*c*, which constitute the first and second magnetic circuits M1, M2 respectively. Thus, a force is applied to the needle valve N in the +Z direction via the first spring S1 and the stopper member FX, whereby the needle valve N moves away from the fuel seal portion PS against a second spring force F2 and a valve-closing force FD resulting from a differential pressure. Hence, the solenoid-operated fuel injection valve is opened, and fuel injection is started.

When the needle valve N is located at a predetermined position before reaching a position corresponding to the first stroke after the start of fuel injection, the supply of current to the second coil M2*c* is stopped. Then, the first armature M1*b* abuts on the first core M1*a*, and the needle valve N substantially stops moving. If the supply of current to the first coil M1*c* is thereafter stopped, the needle valve N is moved in the −Z direction by spring forces F1, F2 of the first and second spring forces. Then, the needle valve N abuts on the inner surface of the container constituting the fuel seal portion PS, and the solenoid-operated fuel injection valve is closed.

In this fuel injection, since the amount of fuel injected at a time is small, the degree of dispersion of fuel is high. Hence, fuel is injected in a widely dispersed and atomized state.

In the operation of closing the solenoid-operated fuel injection valve in this case, the stopper member NS fitted to the needle valve N hits the inner surface of the container constituting the fuel seal portion PS after having been decelerated by temporarily hitting the first armature M1*b* before reaching the position corresponding to the first stroke. Therefore, secondary injection is suppressed.

To shift the solenoid-operated fuel injection valve to an open state with a large fuel injection amount, currents are first supplied from the connector 2 to the first and second coils M1*c*, M2*c* constituting the first and second magnetic circuits M1, M2 at the start of the operation of opening the solenoid-operated fuel injection valve. Thus, a force is applied to the needle valve N in the +Z direction via the first spring S1 and the stopper member FX, whereby the needle valve N moves away from the fuel seal portion PS against the second spring force F2 and a valve-opening force FD resulting from a differential pressure. As a result, the solenoid-operated fuel injection valve is opened, and fuel injection is started.

Even if the needle valve N has reached the position corresponding to the first stroke after the start of fuel injection, the supply of current to the second coil M2*c* is continued. While the first armature M1*b* abuts on the first core M1*a*, the second armature M2*b* is sucked against the spring force F1 of the first spring S1 and the spring force F2 of the second spring S2, and the needle valve N moves further upwards.

At this moment, the supply of current to the first coil M1*c* can be stopped. If the second armature M2*b* abuts on the second coil M2*c*, the needle valve N stops moving at a position corresponding to the second stroke. If the supply of current to the second coil M2*c* (to the first coil M1*c* if necessary) is thereafter stopped, the needle valve N is moved in the −Z direction by the spring forces F1, F2 of the first and second springs. As a result, the needle valve N abuts on the inner surface of the container constituting the fuel seal portion PS, and the solenoid-operated fuel injection valve is closed.

In this fuel injection, since the amount of fuel injected at a time is large, the degree of dispersion of fuel is low. Hence, fuel is injected in a highly penetrative manner.

In the operation of closing the solenoid-operated fuel injection valve in this case as well, the stopper member NS fitted to the needle valve N hits the fuel seal portion PS after having been decelerated by temporarily hitting the first armature M1*b* before reaching the position corresponding to the first stroke. Therefore, secondary injection is suppressed.

Figure 7:
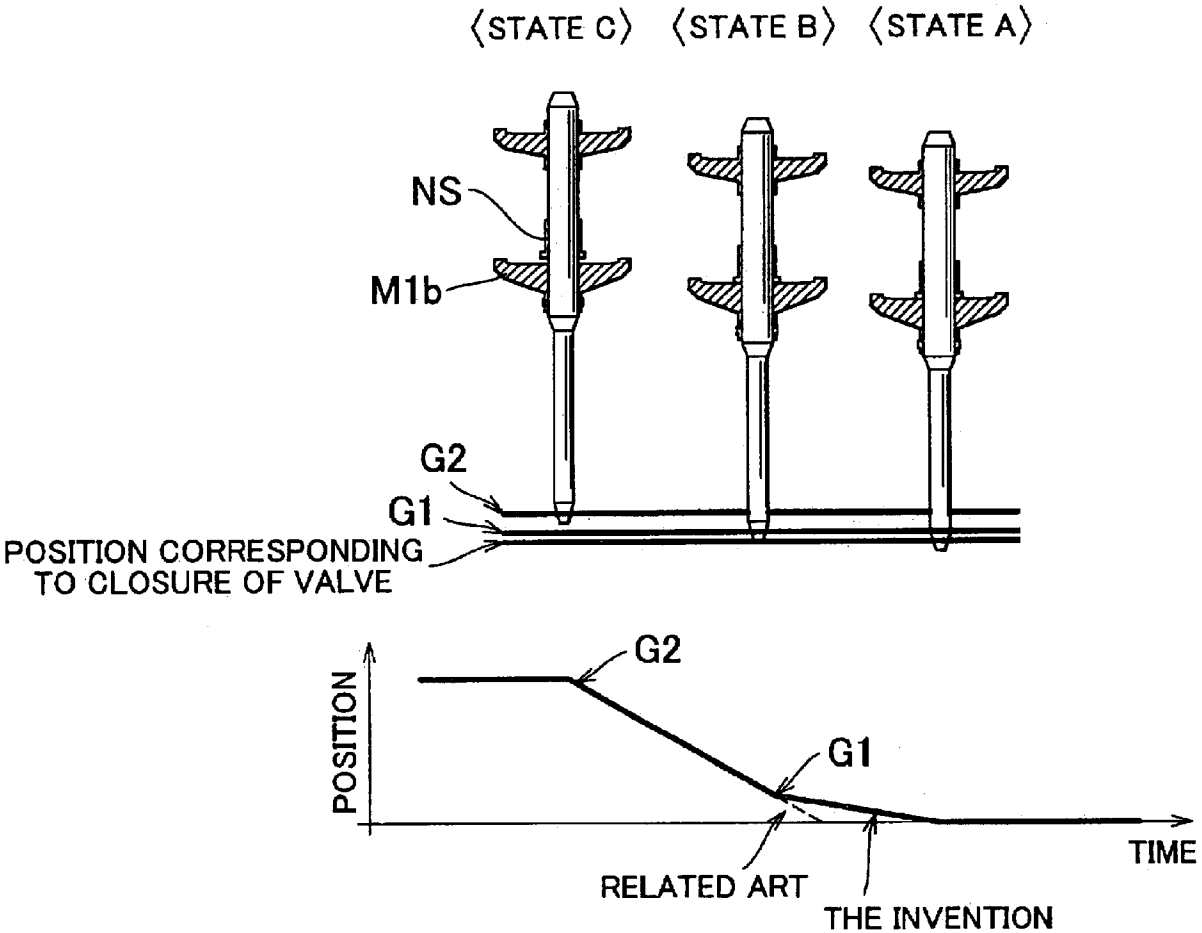
FIG. 7 is an explanatory view of a function of suppressing secondary fuel injection in the solenoid-operated fuel injection valve in accordance with the fourth embodiment.

FIG. 7 is an explanatory view of the function of suppressing secondary injection. In the case where the needle valve N has moved from a closed position (reference position) by the second stroke (state C), the second stroke corresponds to the dimension G2 of the gap A2. In closing the solenoid-operated fuel injection valve, if the needle valve N has approached the closed position beyond the position corresponding to the first stroke (the dimension G1) after the lapse of a certain period, the stopper member NS hits the first armature M1*b*. An impact on the stopper member NS is absorbed by the spring S1 of the first armature M1*b*, and the stopper member NS moves to a position corresponding to closure of the solenoid-operated fuel injection valve while being decelerated together with the first armature M1*b*.

That is, the positional change amount (speed) of the needle valve N per unit time decreases immediately before the needle valve N reaches the closed position. The needle valve N hits the inner surface of the container constituting the fuel seal portion PS at a low speed. Accordingly, the bound of the needle valve N is suppressed, and secondary injection is suppressed.

Figure 8:
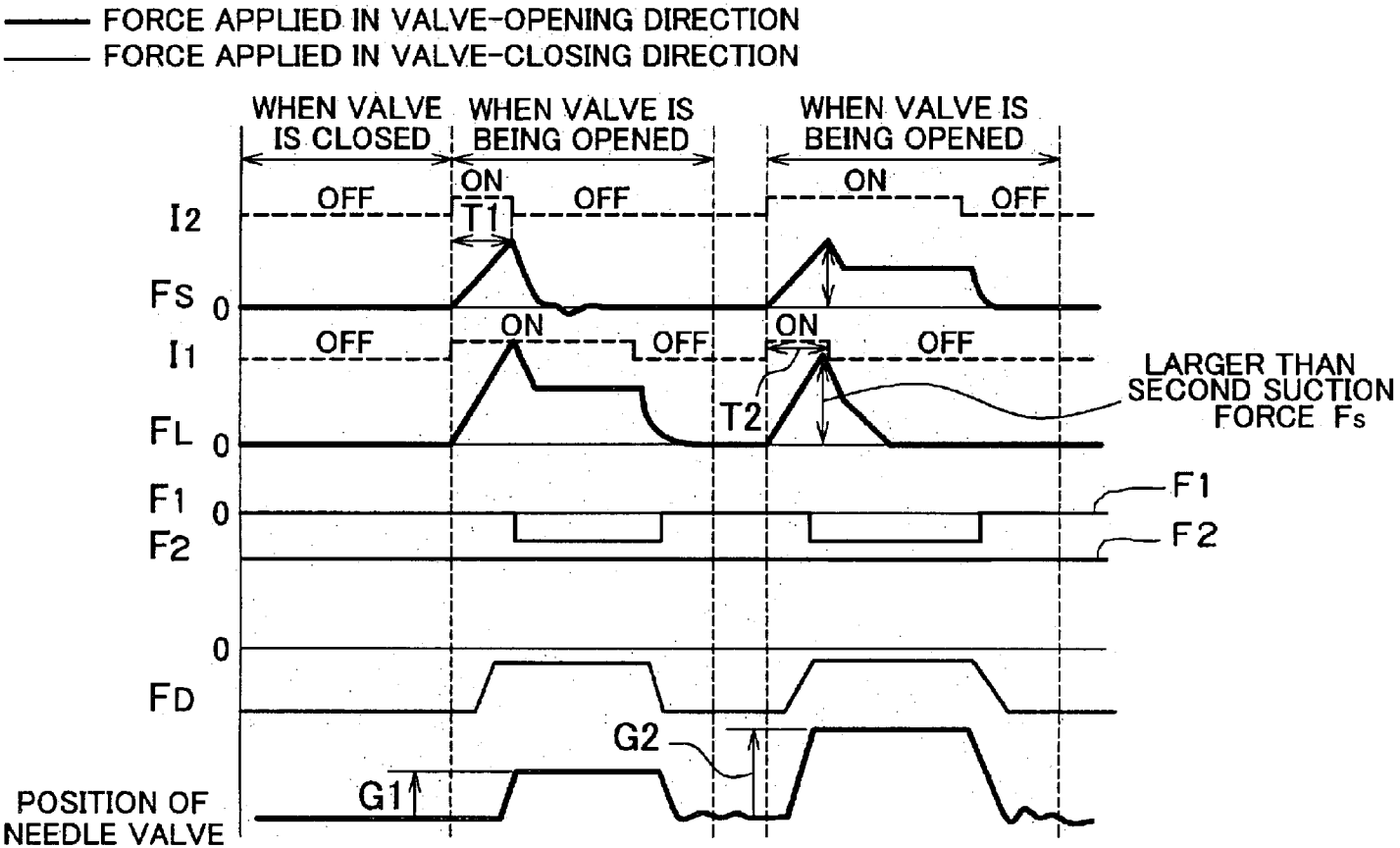
FIG. 8 shows timing charts of currents (drive pulses) I1, I2 supplied to first and second coils M1*c*, M2*c* respectively, suction forces FL, FS, spring forces F1, F2, a valve-closing force FD resulting from a differential pressure, and a needle valve position.

FIG. 8 shows timing charts of currents I1, I2 (solenoid drive pulses) supplied to the coils M1*c*, M2*c*, the suction forces FL, FS, the spring forces F1, F2, the valve-opening force FD resulting from a differential pressure, and the position of the needle valve (1) when the solenoid-operated fuel injection valve is closed, (2) when the solenoid-operated fuel injection valve is opened with a small fuel injection amount, and (3) when the solenoid-operated fuel injection valve is opened with a large fuel injection amount.

When the solenoid-operated fuel injection valve is opened with a small fuel injection amount, the solenoid drive pulses I1, I2 are first supplied simultaneously. After the lapse of a period T1, the drive pulse I2 is stopped (turned OFF). After fuel injection, the drive pulse I1 is stopped (turned OFF) as well. In this manner, the solenoid-operated fuel injection valve is closed.

When the solenoid-operated fuel injection valve is opened with a large fuel injection amount, the solenoid drive pulses I1, I2 are first supplied simultaneously. After the lapse of a period T2, the drive pulse I1 is stopped (turned OFF) while the drive pulse I2 is still being supplied. After fuel injection, the drive pulse I2 is stopped (turned OFF) as well. In this manner, the solenoid-operated fuel injection valve is closed.

As described above, since the stroke of the needle valve N is variable, atomization of fuel can be carried out as required in accordance with engine load, and fuel consumption can be improved. When a small amount of fuel is injected, atomized fuel is widely dispersed, which is suited for combustion in a low-load range. When a large amount of fuel is injected, fuel is highly rectilinearly injected, which is suited for combustion in a high-load range.

It is to be noted herein that the fuel injection amount per unit time is proportional to a duty ratio of the aforementioned drive pulse I1 or I2. In the case where a small amount of fuel is injected, the fuel injection rate can be made relatively low even if the duty ratio is not variable. If the duty ratio is reduced as well, a considerably small amount of fuel can be injected.

In the case where a large amount of fuel is injected, the fuel injection rate can be relatively changed even if the duty ratio is not increased. If the duty ratio is increased as well, a considerably large amount of fuel can be injected. Thus, adoption of the aforementioned construction makes it possible to enlarge a dynamic range of the fuel injection rate.

To open the valve to which a high fuel pressure is applied, a large suction force is required. In the aforementioned construction, while the suction force FL can be increased by making the dimension G1 of the gap A1 relatively narrow, the suction force can be further increased by using a resultant force of the suction forces FL, FS. Thus, it is possible to achieve enhancement of fuel pressure.

Because the two springs S1, S2 are employed, the resultant force of the spring forces F1, F2 acts on the needle valve N when the solenoid-operated fuel injection valve is closed. Hence, the responsive characteristic during the operation of closing the solenoid-operated fuel injection valve is improved. When the solenoid-operated fuel injection valve is opened, only one of the spring forces, namely, the spring force F2 is effective. The degree of contribution of the suction forces to the operation of opening the solenoid-operated fuel injection valve is enhanced. As a result, the responsive characteristic during the operation of opening the solenoid-operated fuel injection valve is improved.

In the aforementioned construction, the first and second magnetic circuits M1, M2 are disposed along the longitudinal direction of the needle valve N. Thus, the suction forces can be increased without enlarging the dimension in the direction perpendicular to the longitudinal direction (i.e., radially).

Reduction of the amount of transpirable gas has been demanded in supplying fuel to an engine. As a fuel supply system satisfying such a demand, a returnless system has been devised. In the aforementioned solenoid-operated fuel injection valve, a returnless structure or a rail pressure built-in structure can also be adopted by directly operating the needle valve N by means of a solenoid.

The solenoid-operated fuel injection valve in accordance with the invention can be reliably opened and closed.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. A solenoid-operated fuel injection valve comprising:

a container into which fuel is introduced;

a needle member that is disposed in the container and that moves longitudinally; and an electromagnetic controller that changes an area of a fuel flow passage defined as a space between an inner surface of the container and an outer surface of the needle member by moving the needle member through suction forces, the electromagnetic controller being provided with first and second magnetic circuits through which the suction forces can be controlled independently of each others, wherein the first magnetic circuit has a pair of magnetic bodies that are opposed and attracted to each other across a first gap, the second magnetic circuit has a pair of magnetic bodies that are opposed and attracted to each other across a second gap, an electromagnet is constituted by one of the pairs of the magnetic bodies, and the magnetic bodies are each disposed between the container and the needle member to longitudinally move the needle member by suction forces of the magnetic bodies.

2. The solenoid-operated fuel injection valve according to claim 1, wherein a first limit stroke of the needle member moved by the first magnetic circuit is shorter than a second limit stroke of the needle member moved by the second magnetic circuit.

3. The solenoid-operated fuel injection valve according to claim 2, wherein the first gap is smaller in dimension than the second gap when suction forces have not been generated.

4. The solenoid-operated fuel injection valve according to claim 2, further comprising:

first and second elastic means that urge the needle member against a direction of application of the suction forces if the needle member has moved in the direction of application of the suction forces by at least the first limit stroke, wherein the first elastic means is disposed in such a manner as to apply a force to the needle member in the same direction as the suction forces if the needle member has not moved in the direction of application of the suction forces by at least the first limit stroke.

5. The solenoid-operated fuel injection valve according to claim 2, further comprising:

elastic means for urging the needle member against a direction of application of the suction forces if the needle member has moved in the direction of application of the suction forces; and a stopper member fitted to the needle member in such a manner as to hit a certain member at a predetermined position between a position corresponding to closure of the needle member and a position corresponding to the first limit stroke if the needle member is moved reversely with respect to the suction forces by an urging force of the elastic means.

6. The solenoid-operated fuel injection valve according to claim 5, wherein the stopper member slows the velocity of the needle member between the first limit position the closure position to prevent secondary injection.

7. The solenoid-operated fuel injection valve according to claim 2, wherein one of the magnetic bodies of the first magnetic circuit is fixed to the container, and the other of the magnetic bodies of the first magnetic circuit is movable relative to the needle member and allows the suction forces to be indirectly transmitted to the needle member.

8. The solenoid-operated fuel injection valve according to claim 7, wherein elastic means is disposed between the other of the magnetic bodies of the first magnetic circuit and the needle member.

9. The solenoid-operated fuel injection valve according to claim 1, wherein the first gap is smaller in dimension than the second gap when the suction forces have not been generated.

10. The solenoid-operated fuel injection valve according to claim 1, wherein one of the magnetic bodies of the first magnetic circuit is fixed to the container, and the other of the magnetic bodies of the first magnetic circuit is movable relative to the needle member and allows the suction forces to be indirectly transmitted to the needle member.

11. The solenoid-operated fuel injection valve according to claim 10, wherein elastic means is disposed between the other of the magnetic bodies of the first magnetic circuit and the needle member.

12. The solenoid-operated fuel injection valve according to claim 10, wherein the first and second magnetic circuits simultaneously generate suction forces during a predetermined period.

13. The solenoid-operated fuel injection valve according to claim 10, wherein the first and second magnetic circuits are longitudinally disposed on the needle member.

14. A solenoid-operated fuel injection valve comprising:

a container into which fuel is introduced;

a needle member that is disposed in the container and that moves longitudinally; and an electromagnetic controller that changes an area of a fuel flow passage defined as a space between an inner surface of the container and an outer surface of the needle member by moving the needle member through suction forces, the electromagnetic controller being provided with first and second magnetic circuits through which the suction forces can be controlled independently of each other, each circuit being defined by a pair of magnetic bodies opposed and attracted to each other across first and second gaps, respectively, of differing distances to longitudinally move the needle member by suction forces of the magnetic bodies when actuated to two different limit stroke positions to provide two differing fuel rates into the container.

15. The solenoid-operated fuel injection valve of claim 14, further comprising:

elastic means that urge the needle member against a direction of application of the suction forces towards a closed position.

16. A method of operating the solenoid-operated fuel injection valve of claim 14, comprising:

initially providing the needle at a closed position in which no fuel is introduced into the container;

actuating at least one of the first and second magnetic circuits by applying solenoid drive pulses thereto to generate a first suction force urging the needle to a first limit stroke position to provide a first small fuel injection rate into the container; and actuating at least one of the first and second magnetic circuits by applying solenoid drive pulses thereto to generate a second suction force urging the needle to a second limit stroke position to provide a second, larger fuel injection rate into the container.

17. A method of operating the solenoid-operated fuel injection valve as recited in claim 16, wherein the first small fuel injection rate is achieved by:

applying solenoid drive pulses to both the first and second magnetic circuits for a first predetermined time period;

stopping activation of the drive pulse to the second magnetic circuit at the expiration of the first time period and prior to reaching the first limit stroke;

applying a solenoid drive pulse solely to the first circuit for a second time period to urge the needle to the first limit stroke; and after reaching the first limit stroke, and expiration of the second time period, stopping activation of the drive pulse to the first magnetic circuit to return the needle toward the closed position.

18. A method of operating the solenoid-operated fuel injection valve as recited in claim 16, wherein the second, larger fuel injection rate is achieved by:

applying solenoid drive pulses to both the first and second magnetic circuits for a first predetermined time period;

stopping activation of the solenoid drive pulse to the first magnetic circuit upon expiration of the first predetermined time period;

applying the solenoid drive pulse to the second magnetic circuit for a second time period to urge the needle to the second limit stroke; and after reaching the second limit stroke and expiration of the second time period, stopping activation of the drive pulse to the second magnetic circuit to return the needle toward the closed position.

19. The method of claim 16, further comprising:

contacting the needle member with a stopper member between the first limit stroke position and the closed position to slow the velocity of the needle member prior to reaching the closed position.

20. A solenoid-operated fuel injection valve, comprising:

a container into which fuel is introduced;

a needle member that is disposed in the container and that moves longitudinally; and an electromagnetic controller that changes an area of a fuel flow passage defined as a space between an inner surface of the container and an outer surface of the needle member by moving the needle member through suction forces, the electromagnetic controller being provided with first and second magnetic circuits through which the suction forces can be controlled independently of each other, wherein the first and second magnetic circuits each move the needle member, by suction forces of the magnetic bodies when actuated, in a same direction.

21. The solenoid-operated fuel injection valve according to claim 20, wherein the direction is a direction that increases the area of the fuel flow passage.

* * * * *